US008453358B2

(12) United States Patent
Ropog

(10) Patent No.: US 8,453,358 B2
(45) Date of Patent: Jun. 4, 2013

(54) DUAL COMPRESSION SPRING RAM

(75) Inventor: Jim Ropog, North Olmsted, OH (US)

(73) Assignee: Meyer Products, LLC, Cleveland, OH (US)

( * ) Notice: Subject to any disclaimer, the term of this patent is extended or adjusted under 35 U.S.C. 154(b) by 380 days.

(21) Appl. No.: 13/008,542

(22) Filed: Jan. 18, 2011

(65) Prior Publication Data

US 2011/0173847 A1 Jul. 21, 2011

Related U.S. Application Data

(60) Provisional application No. 61/296,054, filed on Jan. 19, 2010.

(51) Int. Cl.
*E01H 5/04* (2006.01)

(52) U.S. Cl.
USPC ..... 37/231

(58) Field of Classification Search
USPC ..... 37/219–231, 236, 266, 264; 172/811, 172/817, 828
See application file for complete search history.

(56) References Cited

U.S. PATENT DOCUMENTS

| | | | |
|---|---|---|---|
| 4,073,077 | A | 2/1978 | Essel et al. |
| 4,074,448 | A | 2/1978 | Niemela |
| 4,635,387 | A | 1/1987 | Haring |
| 5,485,690 | A | 1/1996 | MacQueen |
| 6,526,677 | B1 | 3/2003 | Bloxdorf et al. |
| 6,983,558 | B2 | 1/2006 | Haas |
| 7,028,423 | B1 | 4/2006 | Curry |

FOREIGN PATENT DOCUMENTS

| | | |
|---|---|---|
| JP | 63-095726 | 6/1988 |
| JP | 04-309609 | 11/1992 |
| KR | 10-0408486 | 12/2003 |
| KR | 10-0465479 | 1/2005 |

OTHER PUBLICATIONS

PCT—Notification of Transmittal International Preliminary Report and the Written Opinion of the International Searching Authority, Oct. 4. 2011.

PCT—International Search Report, Oct. 4, 2011.

PCT—International Written Opinion, Oct. 4, 2011.

*Primary Examiner* — Robert Pezzuto

(74) *Attorney, Agent, or Firm* — Roger D. Emerson; Timothy D. Bennett; Emerson Thomson Bennett

(57) ABSTRACT

A snowplow assembly includes a mount assembly operatively connected to an associated vehicle, a plow blade assembly pivotally connected to the mount assembly, and a cylinder with a first end pivotally connected to the mount assembly and a second end pivotally connected to the plow blade assembly. The cylinder can include at least one resilient member. The resilient member exerts a force in a first direction when the plow blade assembly is in a first angled position, and the resilient member exerts a force in a second direction when the plow blade assembly is in a second angled position.

20 Claims, 15 Drawing Sheets

DUAL COMPRESSION SPRING RAM

CROSS-REFERENCE TO RELATED APPLICATIONS

This application claims the benefit of U.S. Provisional Application No. 61/296,054, titled DUAL COMPRESSION SPRING RAM, filed Jan. 19, 2010, which is herein incorporated by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

This invention relates generally to snowplows and more specifically to cylinders and rams for snowplows.

2. Description of Related Art

It is well known in the art to provide a snowplow on the front of a vehicle for displacing snow, sleet, ice and the like along a roadway, driveway, or other ground surface. Generally, a snowplow assembly will include a plow blade that is used to contact the snow and a mount assembly that is used to mount the snowplow mechanism to the vehicle. Many snowplow assemblies pivotally attach the plow blade to the mount assembly allowing the blade to pivot about a vertical pivot axis and direct plowed snow to either side of the vehicle path. The snowplow assembly may include one or more pneumatic or hydraulic cylinders to pivot the plow blade about the vertical pivot axis and direct the plowed snow. Often, these cylinders can be controlled from inside the vehicle during plowing. The mount assemblies are often pivotally attached to a vehicle for selectively raising and lowering the snowplow assembly using hydraulic controls located in the vehicle. The plow blade may also be pivotally attached to the mount assembly allowing the plow blade (or a portion of the blade) to pivot about a horizontal mounting axis. Springs, or trip springs, may connect between the plow blade and the mount assembly for biasing the plow blade in an upright position and for dampening the rotational movement about the horizontal mounting axis when the plow blade encounters an obstacle. This mechanism is often referred to as a trip or trip spring assembly.

While known plow blades generally work well for their intended purpose, they have disadvantages. One disadvantage is that known pneumatic and hydraulic cylinders can be heavy, which adds additional unwanted weight to a snowplow assembly. Therefore, what is needed is a snowplow assembly that resolves one or more of disadvantages in the prior art.

BRIEF SUMMARY OF THE INVENTION

According to one embodiment of this invention, a snowplow assembly includes a mount assembly operatively connected to an associated vehicle; a plow blade assembly including a plow blade with a snow engaging surface for plowing snow, wherein the plow blade assembly is pivotally connected to the mount assembly; a cylinder including a cylinder housing, a piston, a piston rod, and first and second resilient members located substantially within the cylinder housing, wherein a first end of the cylinder is pivotally connected to the mount assembly and a second end of the cylinder is pivotally connected to the plow blade assembly. In some embodiments, the first and second resilient members are in an equilibrium condition when the plow blade assembly is in a substantially straight position; the first resilient member compresses when the plow blade assembly is in a first angled position; and the second resilient member compresses when the plow blade assembly is in a second angled position.

According to some embodiments, the snowplow assembly can include a second cylinder having a second cylinder housing, a second piston, a second piston rod, and third and fourth resilient members located substantially within the cylinder housing, wherein a first end of the second cylinder is pivotally connected to the mount assembly and a second end of the second cylinder is pivotally connected to the plow blade assembly. In some embodiments, the third and fourth resilient members are in an equilibrium condition when the plow blade assembly is in a substantially straight position; the fourth resilient member compresses when the plow blade assembly is in a first angled position; and the third resilient member compresses when the plow blade assembly is in a second angled position.

According to some embodiments, the snowplow assembly can include a locking device which can maintain the plow blade assembly in one of the first angled position or the second angled position. The snowplow assembly can include a first stop device which limits the travel of the plow blade assembly in one of the first angled position or the second angled position; and a second stop device which limits the travel of the plow blade assembly in one of the first angled position or the second angled position. The snowplow assembly can include a jack stand pivotally connected to the mount assembly, wherein the jack stand pivots between a use position supporting the snowplow assembly and a storage position. The jack stand can include a height adjustment mechanism to adjust the height of the jack stand; and a roller device positioned near one end of the jack stand to contact a ground surface in the use position.

According to some embodiments, the snowplow assembly can include first and second locking devices secured to the mount assembly; first and second stop devices secured to the plow blade assembly; wherein the first locking device can attach to the first stop device when the plow blade assembly is in the first angled position maintaining the plow blade assembly in the first angled position; and wherein the second locking device can attach to the second stop device when the plow blade assembly is in the second angled position maintaining the plow blade assembly in the second angled position.

According to another embodiment, a snowplow assembly includes a mount assembly operatively connected to an associated vehicle; a plow blade assembly including a plow blade with a snow engaging surface for plowing snow, wherein the plow blade assembly is pivotally connected to the mount assembly; a cylinder including a cylinder housing, a piston, a piston rod, and first and second resilient members located substantially within the cylinder housing, wherein a first end of the cylinder is pivotally connected to the mount assembly and a second end of the cylinder is pivotally connected to the plow blade assembly. In some embodiments, the first and second resilient members are in an equilibrium condition when the plow blade assembly is in a substantially straight position; the first resilient member extends when the plow blade assembly is in a first angled position; and the second resilient member extends when the plow blade assembly is in a second angled position.

According to some embodiments, the snowplow assembly can include a second cylinder having a second cylinder housing, a second piston, a second piston rod, and third and fourth resilient members located substantially within the cylinder housing, wherein a first end of the second cylinder is pivotally connected to the mount assembly and a second end of the second cylinder is pivotally connected to the plow blade assembly. In some embodiments, the third and fourth resilient members are in an equilibrium condition when the plow blade assembly is in a substantially straight position; the fourth resilient member extends when the plow blade assembly is in a first angled position; and the third resilient member extends when the plow blade assembly is in a second angled position. The second resilient member can compress when the plow blade assembly is in a first angled position, and the first resilient member can compress when the plow blade assembly is in a second angled position.

According to another embodiment, a snowplow assembly includes a mount assembly operatively connected to an associated vehicle; a plow blade assembly including a plow blade with a snow engaging surface for plowing snow, wherein the plow blade assembly is pivotally connected to the mount assembly; a cylinder including a cylinder housing, a piston, a piston rod, and a resilient member located substantially within the cylinder housing, wherein a first end of the cylinder is pivotally connected to the mount assembly and a second end of the cylinder is pivotally connected to the plow blade assembly. In some embodiments, the resilient member is in an equilibrium condition when the plow blade assembly is in a substantially straight position; the resilient member compresses when the plow blade assembly is in a first angled position; and the resilient member extends when the plow blade assembly is in a second angled position.

The snowplow assembly can include a second cylinder including a second cylinder housing, a second piston, a second piston rod, and a second resilient member located substantially within the second cylinder housing, wherein a first end of the second cylinder is pivotally connected to the mount assembly and a second end of the cylinder is pivotally connected to the plow blade assembly. In some embodiments, the second resilient member is in an equilibrium condition when the plow blade assembly is in a substantially straight position; the second resilient member extends when the plow blade assembly is in a first angled position; and the second resilient member compresses when the plow blade assembly is in a second angled position.

One advantage of this invention is that the snowplow assembly is lightweight. Other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
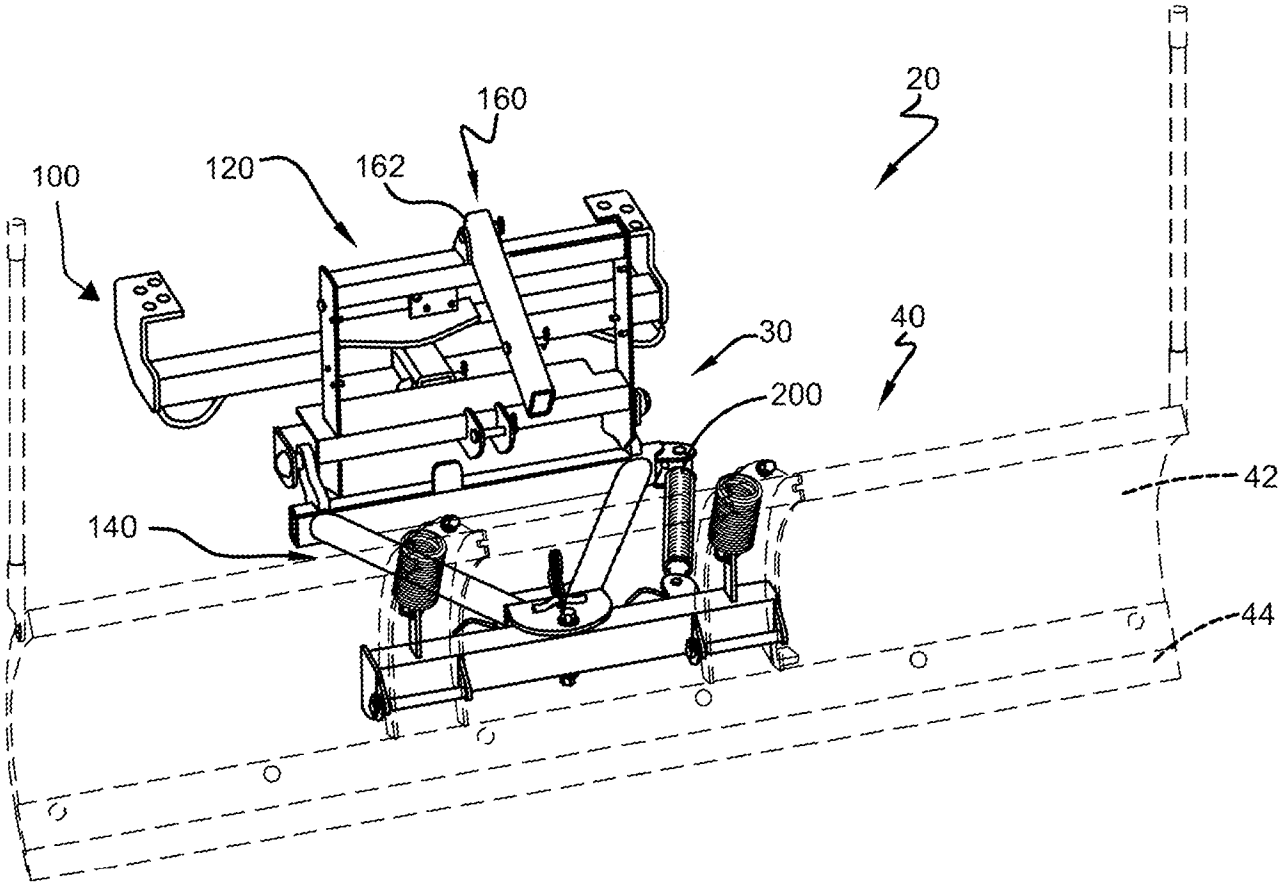
FIG. 1 is a perspective view of a snowplow assembly, according to one embodiment.

Referring now to the drawings wherein the showings are for purposes of illustrating embodiments of the invention only and not for purposes of limiting the same, and wherein like reference numerals are understood to refer to like components, FIG. 1 shows a snowplow assembly 20 including a mount assembly 30 and a plow blade assembly 40, according to one embodiment of this invention. With reference to all the FIGURES, the mount assembly 30 can include a frame mount assembly 100, which is secured to the frame members of a vehicle (not shown), a support assembly 120 secured to the frame mount assembly 100, a plow mount assembly 140 secured to the support assembly, and a lift mount assembly 160 which is also secured to the support assembly 120. The lift mount assembly 160 can include a lift bar 162 and a cylinder (not shown) for raising and lowering the plow mount assembly 140 and the plow blade assembly 40. The plow blade assembly 40 includes an inwardly curved moldboard or plow blade 42 and a scraper blade 44 attached to the bottom of plow blade 40. The plow mount assembly 140 can include a general A-frame shape with an apex 142 of the A-frame pivotally connected to the plow blade assembly 40 and a base 144 of the A-frame pivotally connected to the support assembly 120. The apex 142 can include a C-shaped or U-shaped bracket 150 used to pivotally connect the plow mount assembly 140 or A-frame to the plow blade assembly 40. The plow blade assembly 40 can include one or more trip springs 46 connected between the plow blade 42 and a mount bar 48.

Figure 2:
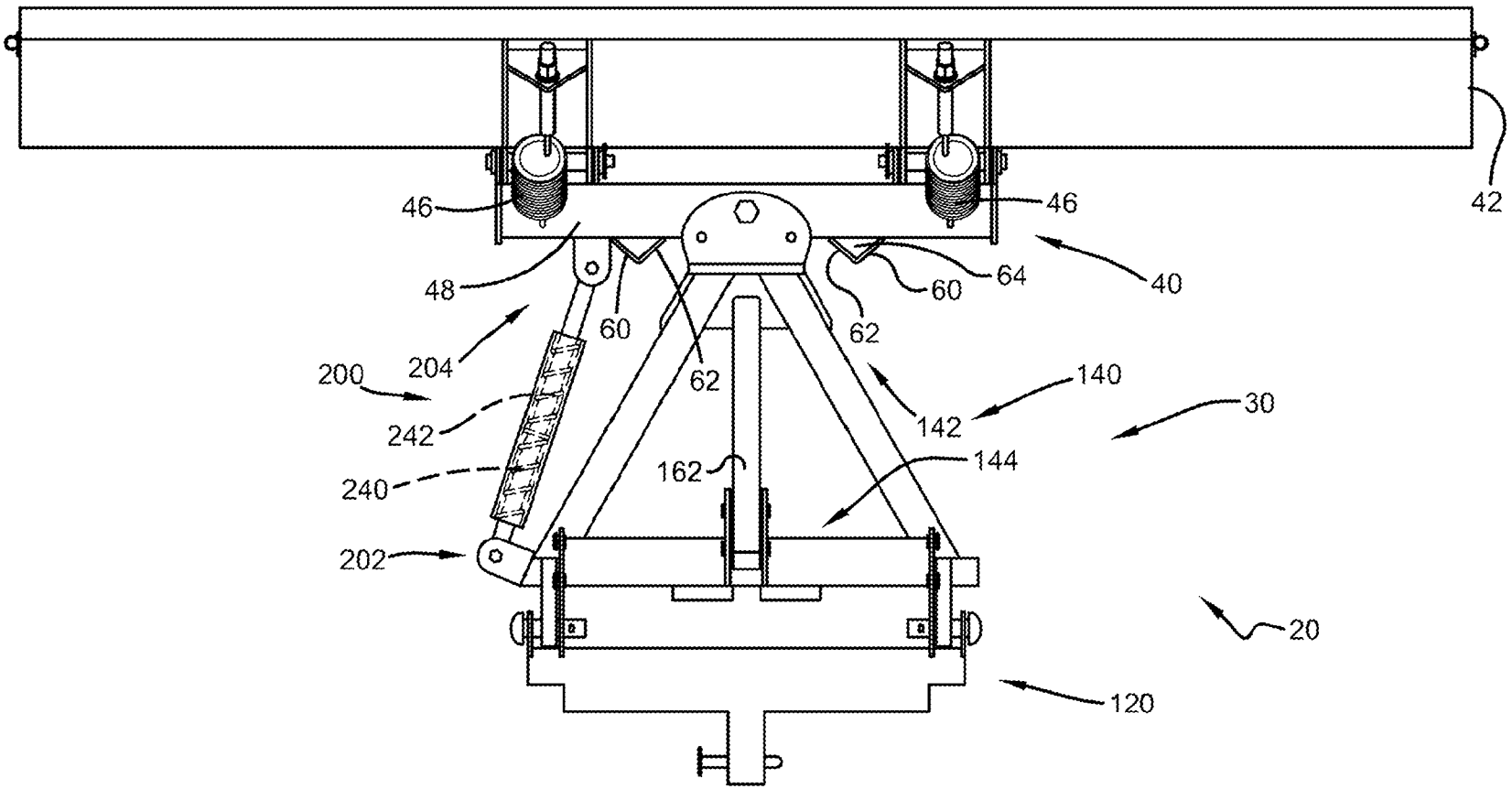
FIG. 2 is a top view of a snowplow assembly illustrating the internal components of a cylinder when the snowplow is in a straight position, according to one embodiment.
Figure 3:
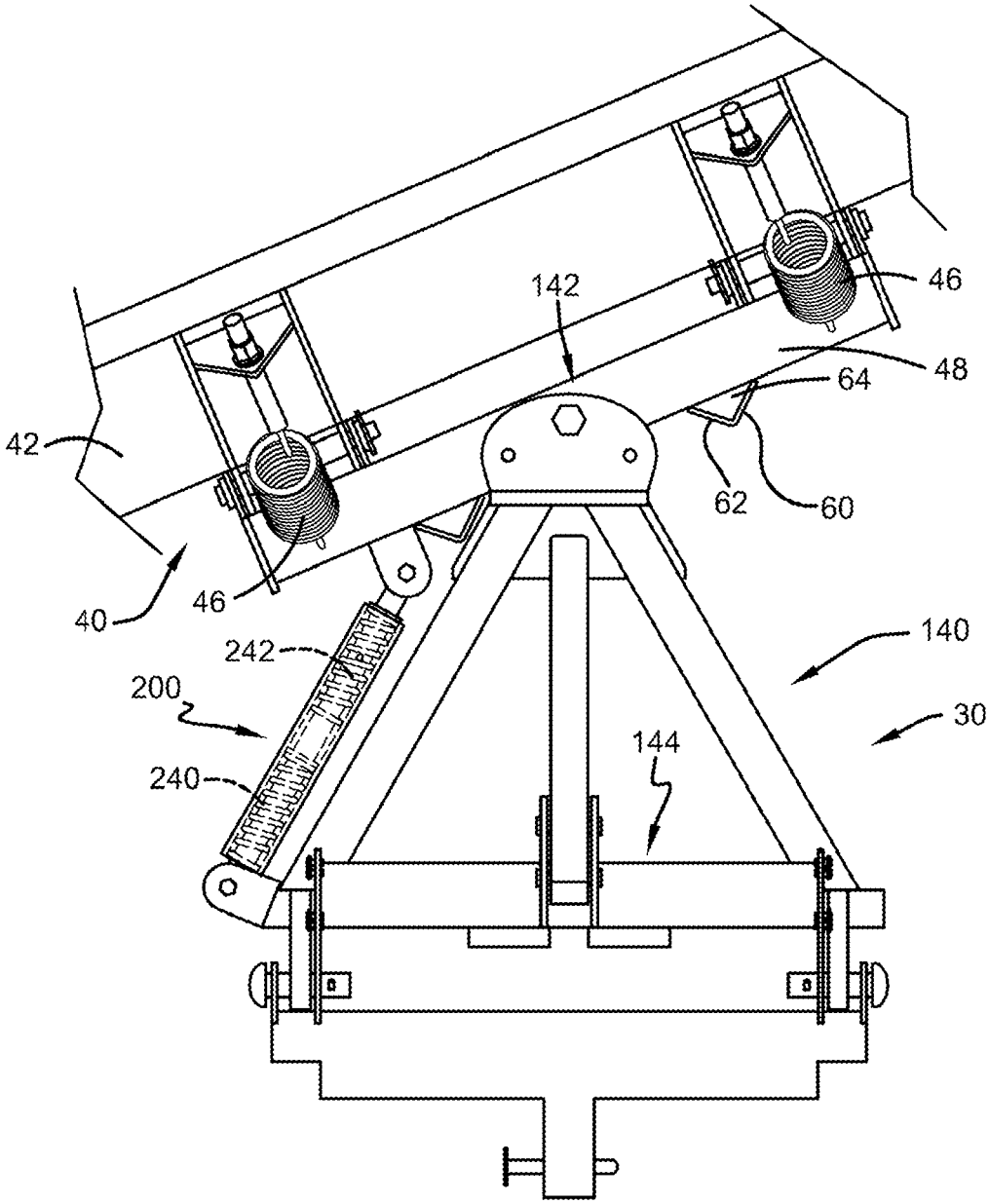
FIG. 3 is a top view of a snowplow assembly illustrating the internal components of a cylinder when the snowplow is in a first angled position, according to one embodiment.
Figure 4:
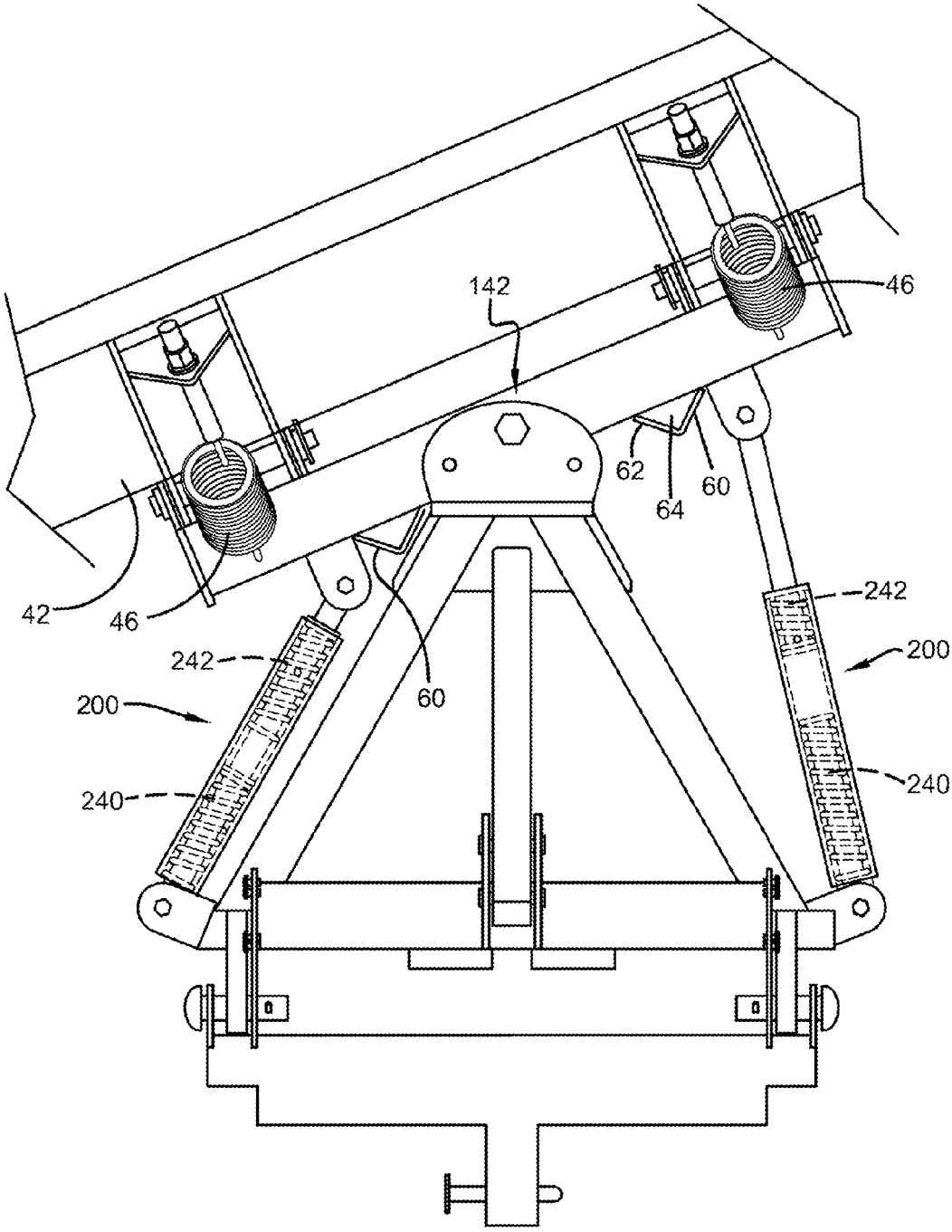
FIG. 4 is a top view of a snowplow assembly illustrating the internal components of two cylinders when the snowplow is in a first angled position, according to one embodiment.

With reference to FIGS. 2-8, the snowplow assembly 20 can include a cylinder 200 with one end 204 pivotally connected to the plow blade assembly 40 and the other end 202 pivotally connected to the plow mount assembly 140 of the mount assembly 40. The cylinder 200 can include a cylinder housing 210, a piston 220, a piston rod 230, and a resilient member 240, as shown in FIGS. 8A and 8B. In some embodiments, the cylinder 200 can include one resilient member 240, and in other embodiments, the cylinder 200 can include two resilient members 240. According to other embodiments, the cylinder 200 can include more than two resilient members 240. When the cylinder 200 includes multiple resilient members 240, the resilient members 240 can be different from each other or they can be substantially identical to each other. In some embodiments, the resilient members 240 are springs, which can operate in compression, in tension, or in both. Any type of spring can be chosen by a person of ordinary skill in the art. The piston 220 is sized to slide within the cylinder housing 210 and to engage the resilient members 240. The piston 220 can be a protruding rim or flange located near one end of the piston rod 230. The piston 220, the piston rod 230, or both can compress or extend the resilient members 240. In some embodiments, the snowplow assembly 20 can include a second cylinder 200 located on the opposite side of the plow mount assembly 140 from the first cylinder 200, as shown in FIG. 4.

According to some embodiments, the snowplow assembly 20 includes one cylinder 200 having two springs 240, 242. The springs 240, 242 can be positioned within the cylinder housing 210 with one resilient member 240 located on one side of the piston 220 and the second resilient member 242 on the opposite side of the piston 220. When the cylinder 200 is in a neutral position, as shown in FIG. 2, both springs 240, 242 can be in an equilibrium condition, in which the springs 240, 242 are exerting substantially no force on the piston 220, also called a relaxed condition, or the springs 240, 242 are exerting substantially equal or balanced forces on the piston 220. The cylinder 200 can maintain the plow blade assembly 40 in a straight or neutral orientation or position until an offset force acts on the plow blade assembly 40 to overcome the force of one or both of the resilient members 240, 242. When the cylinder 200 is in a retracted or extended position, the springs 240, 242 exert unequal forces on the piston 220.

Figure 5:
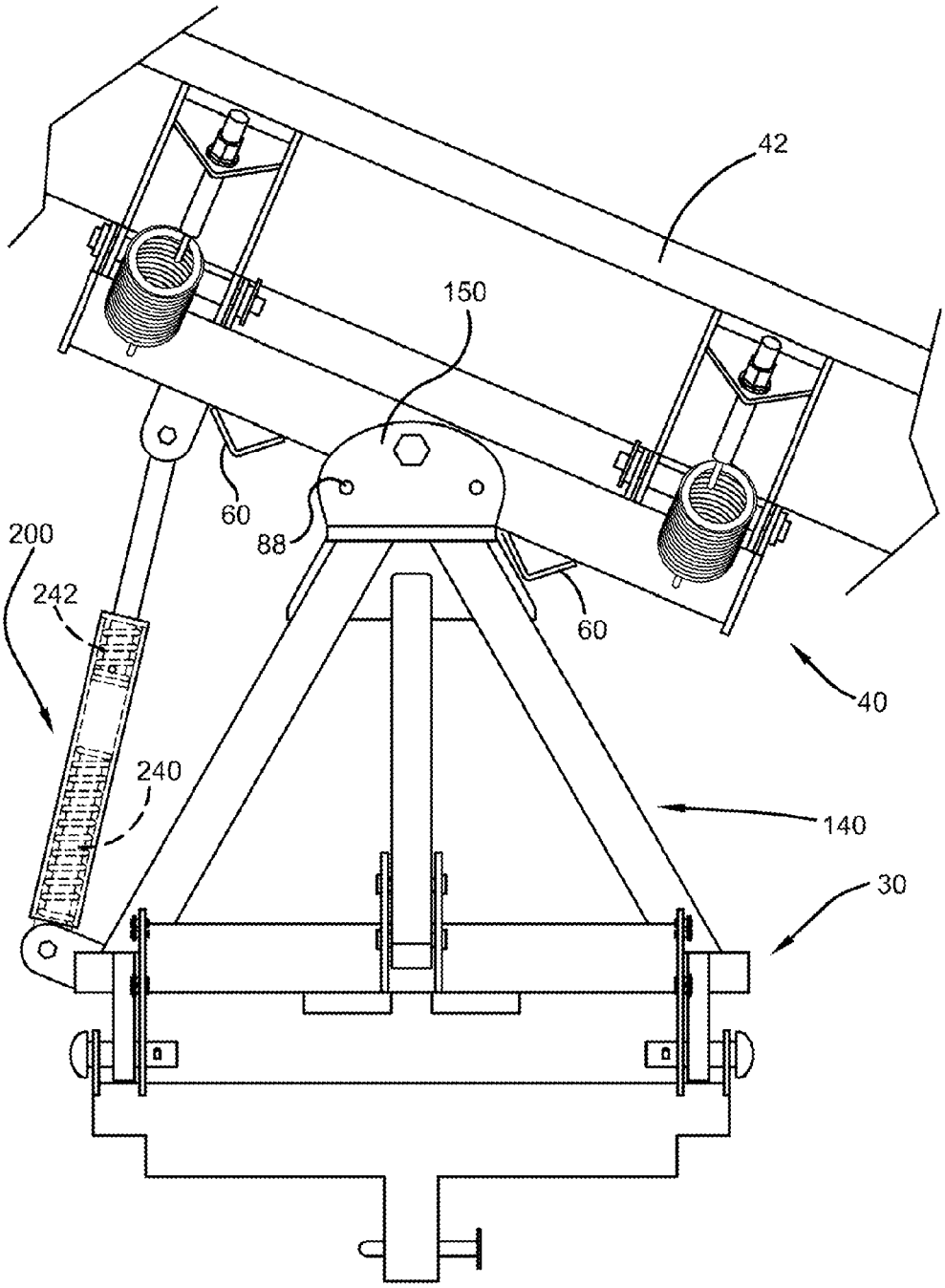
FIG. 5 is a top view of a snowplow assembly illustrating the internal components of a cylinder when the snowplow is in a second angled position, according to one embodiment.
Figure 6A:
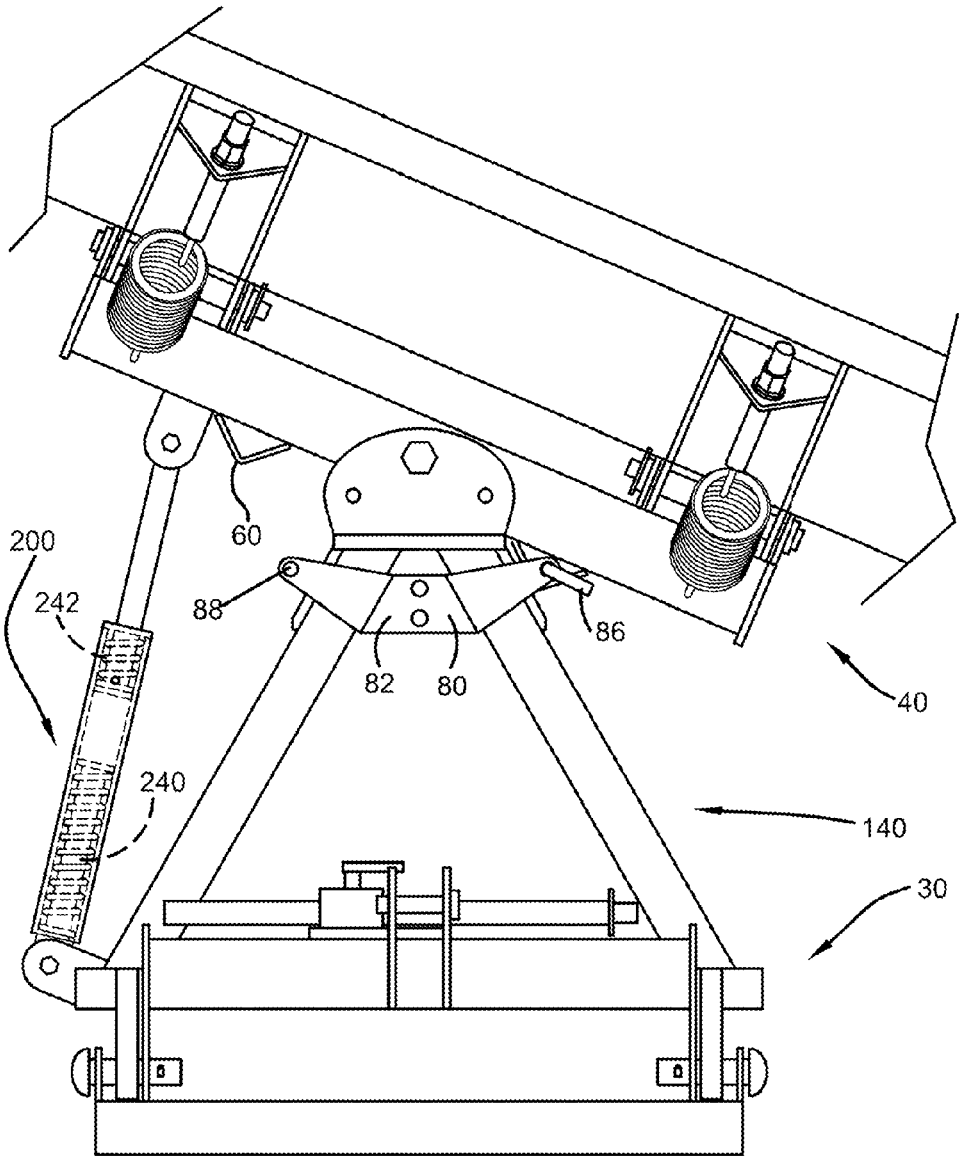
FIG. 6A is a top view of a snowplow assembly illustrating the internal components of a cylinder when the snowplow is in a second angled position, according to one embodiment.
Figure 6B:
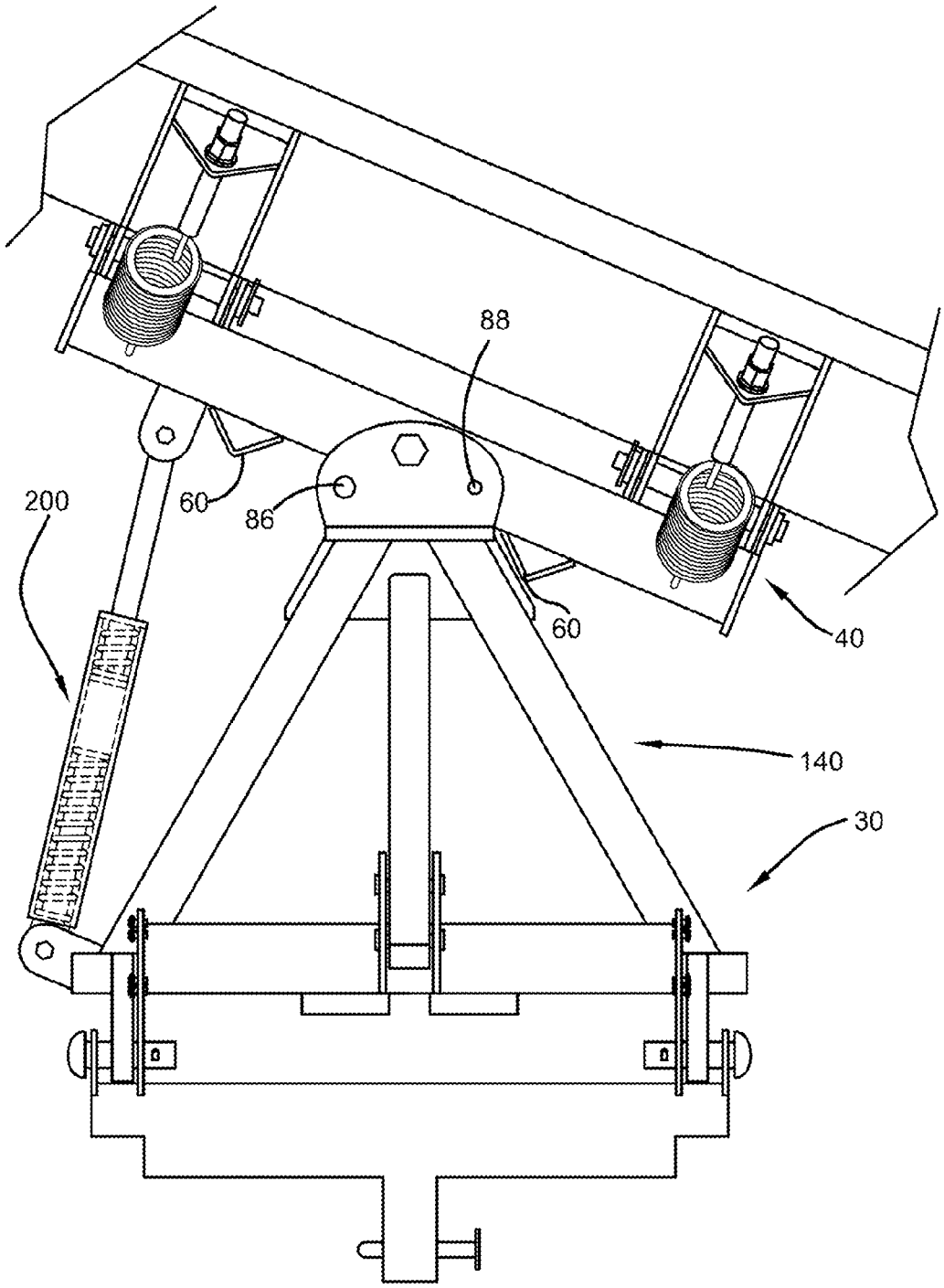
FIG. 6B is a top view of a snowplow assembly illustrating the internal components of a cylinder when the snowplow is in a second angled position, according to one embodiment.

In some embodiments, the springs 240, 242 can operate in compression to exert a force on the piston 220. When the cylinder 200 is in a retracted position, as shown in FIGS. 3 and 4, the first resilient member 240 compresses which exerts a force on the piston 220 in a first direction, and the second resilient member 242 at least partially relaxes or remains in a relaxed condition. When the cylinder 200 is in an extended position, as shown in FIGS. 5-7, the second resilient member 242 compresses which exerts a force on the piston 220 in a second direction, and the first spring 240 at least partially relaxes or remains in a relaxed condition. The first and second directions can be in substantially opposite directions.

In other embodiments, the springs 240, 242 can operate in tension to exert a force on the piston 220. When the cylinder 200 is in a retracted position, the second spring 242 extends which exerts a force on the piston 220 in a first direction, and the first spring 240 at least partially relaxes or remains in a relaxed condition. When the cylinder 200 is in an extended position, the first spring 240 extends which exerts a force on the piston 220 in a second direction, and the second spring 242 at least partially relaxes or remains in a relaxed condition.

In still other embodiments, the springs 240, 242 can operate in both compression and tension to exert a force on the piston 220. When the cylinder 200 is in a retracted position, the first resilient member 240 compresses which exerts a force on the piston 220 in a first direction, and the second spring 242 extends which also exerts a force on the piston 220 in the first direction. When the cylinder 200 is in an extended position, the second resilient member 242 compresses which exerts a force on the piston 220 in a second direction, and the first spring 240 extends which also exerts a force on the piston 220 in the second direction.

According to some embodiments, the snowplow assembly 20 includes one cylinder 200 having one spring 240. The spring 240 can be positioned within the cylinder housing 210 and can be located on either side of the piston 220. When the cylinder 200 is in a neutral position, as shown in FIG. 2, the spring 240 can be in an equilibrium condition where the springs are exerting substantially no force on the piston 220 or where the springs 240, 242 are exerting substantially equal forces on the piston 220. When the cylinder 200 is in a retracted or extended position, the spring 240 can exert a force on the piston 220 in either compression or tension. In some embodiments, when the cylinder 200 is in a retracted position, the spring 240 compresses exerting a force on the piston 220 in a first direction, and when the cylinder 200 is in an extended position, the spring 240 extends exerting a force on the piston 220 in a second direction. In other embodiments, when the cylinder 200 is in a retracted position, the spring 240 extends exerting a force on the piston 220 in a first direction, and when the cylinder 200 is in an extended position, the spring 240 compresses exerting a force on the piston 220 in a second direction.

In some embodiments, the cylinder 200 is in a retracted position when the snowplow assembly 20 is in the first angled position, and the cylinder 200 is in an extended position when the snowplow assembly 20 is in the second angled position. In other embodiments, the cylinder 200 is in an extended position when the snowplow assembly 20 is in the first angled position, and the cylinder 200 is in a retracted position when the snowplow assembly 20 is in the second angled position.

The snowplow assembly 20 can include a stop device 60, which can limit the travel of the plow blade assembly 40 in an angled position. The stop device 60 can limit the travel of the plow blade assembly 40 in a first angled position shown in FIGS. 3 and 4, or in a second angled position shown in FIGS. 5-7. The plow mount assembly 140 makes contact with the stop device 60 in the first or second angled position. The stop device 60 provides a surface 62 to contact the plow mount assembly 140. In some embodiments, the stop device 60 a stop plate or angle bracket. The stop plate 60 can be positioned on the mount bar 48 to create an opening 64 between the stop plate 60 and the mount bar 48. In some embodiments, the snowplow assembly 20 includes two stop devices 60, 60 with one located on either side of the plow mount assembly 140.

Figure 7A:
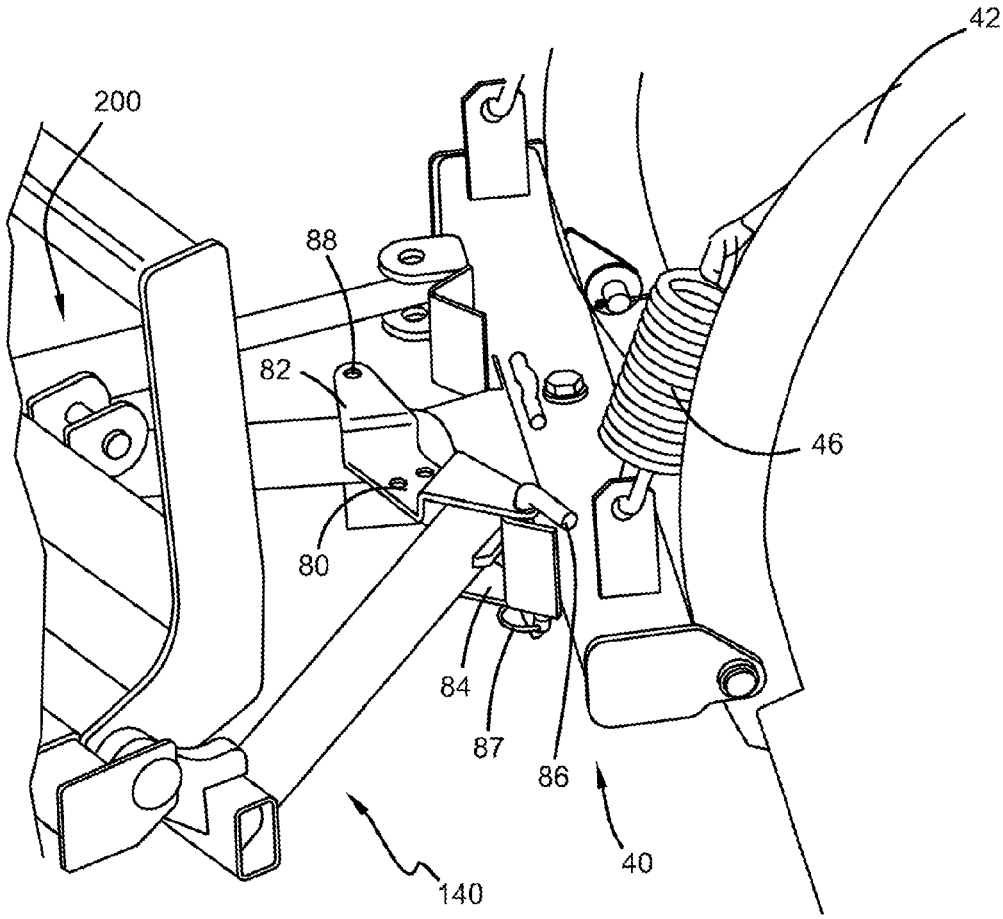
FIG. 7A is a side perspective view of a snowplow assembly illustrating the locking device when the snowplow is in a second angled position, according to one embodiment.

The snowplow assembly 20 can include a locking device 80, which can maintain the plow blade assembly 40 in an angled position. The locking device 80 can maintain the plow blade assembly 40 in a first angled position shown in FIGS. 3 and 4, or in a second angled position shown in FIGS. 5-7. According to some embodiments, the locking device 80 can include a top bracket 82, a bottom bracket 84, and a retaining device 86. The top and bottom brackets 82, 84 can each include an aperture 88, which receives the retaining device 86. The retaining device 86 can be a pin, bolt, or any other fastener with a head 90. When the plow blade assembly 40 is in either the first or second angled position, the apertures 88 in the top and bottom brackets 82, 84 of the locking device 80 align with the opening 64 in the stop plate 60. The retaining device 86 can then pass through the aperture 88 in the top bracket 82, the opening 64 between the stop plate 60 and the mount bar 48, and the aperture 88 in the bottom bracket 84, as shown in FIG. 7A. In addition, a cotter pin or locking pin 87 can be inserted into an opening in the retaining device 86 to maintain the retaining device within the apertures 88, 88 and opening 64. This secures the plow blade assembly 40 to the plow mount assembly 140 in the first or second angled position. In some embodiments, the snowplow assembly 20 includes two locking devices 80, 80 with one located on either side of the plow mount assembly 140.

Figure 7B:
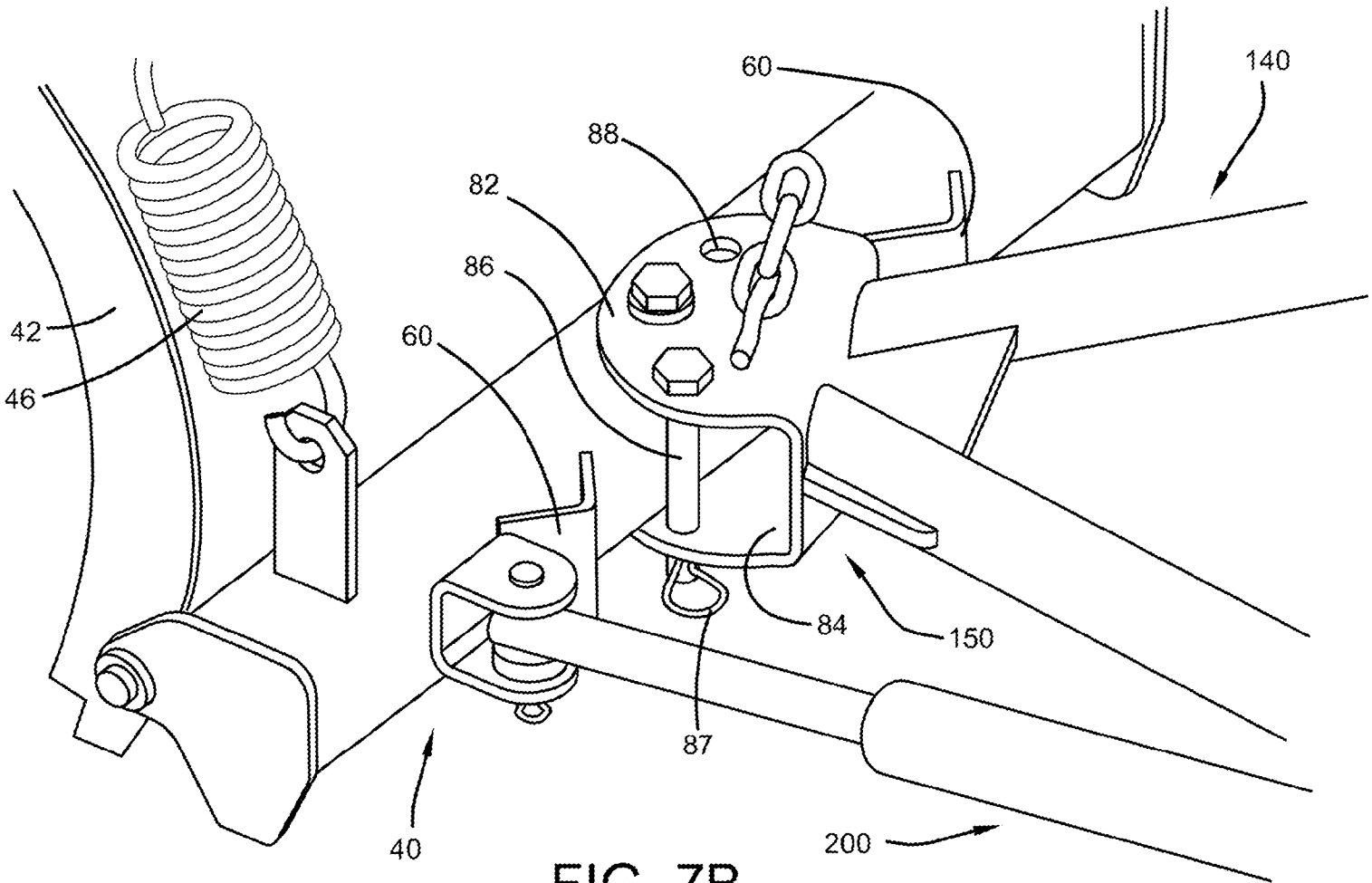
FIG. 7B is a side perspective view of a snowplow assembly illustrating the locking device when the snowplow is in a second angled position, according to one embodiment.
Figure 8B:
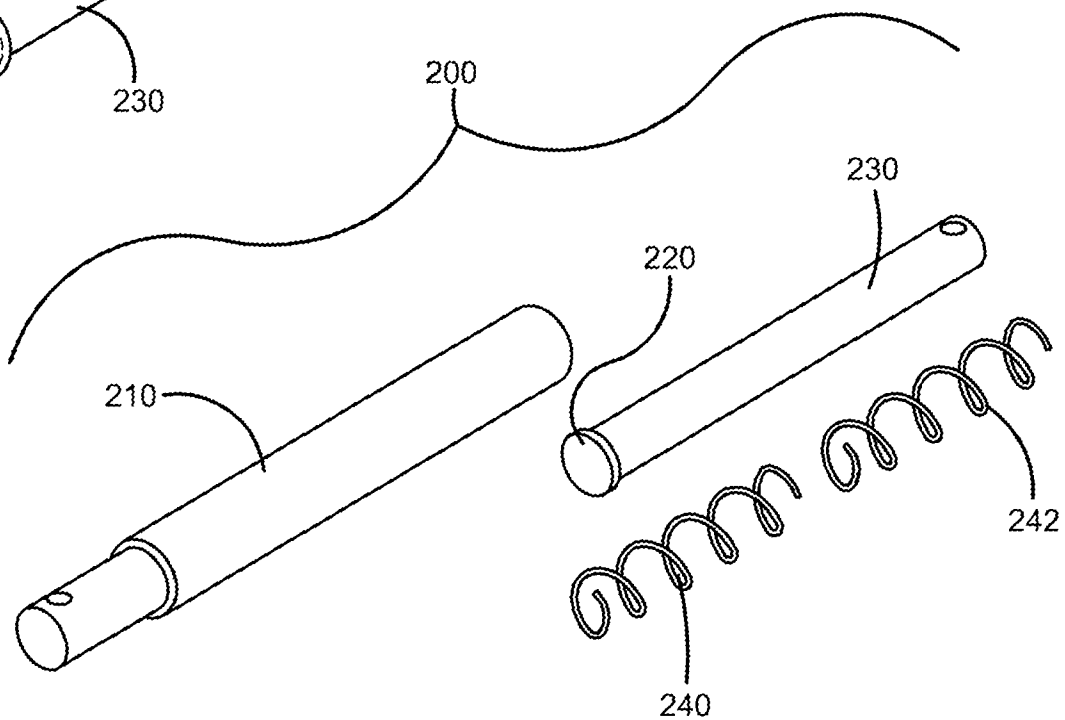
FIG. 8B is a perspective view of a disassembled cylinder illustrating the components of the cylinder, according to one embodiment.
Figure 8A:
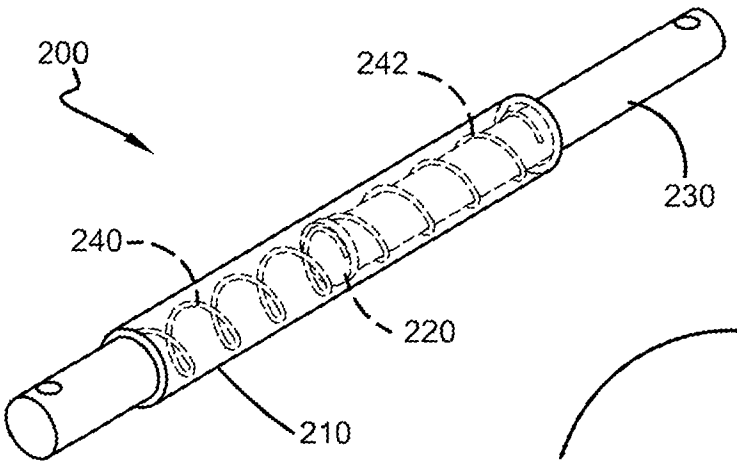
FIG. 8A is a perspective view of an assembled cylinder illustrating the internal components of the cylinder, according to one embodiment.

According to other embodiments, the locking device 80 can include a bracket 150 and a retaining device 86. The top and bottom portions 82, 84 of the bracket 150 can each include an aperture 88, which receives the retaining device 86. The retaining device 86 can be any fastener chosen by a person of ordinary skill in the art. When the plow blade assembly 40 is in either the first or second angled position, the retaining device 86 can be inserted into the aperture 88 in the top portion 82 and the aperture 88 in the bottom portion 84, as shown in FIG. 7B. The retaining device 86 contacts the mount bar 48, which maintains the plow blade assembly 40 in either the first or second angled position. In an alternate embodiment, when the plow blade assembly 40 is in either the first or second angled position, the apertures 88 in the top and bottom portions 82, 84 of the bracket 150 can align with an opening in the mount bar 48. The retaining device 86 can then pass through the apertures 88, 88 in the bracket 150 and the opening in the mount bar 48. A cotter pin or locking pin 87 can be inserted into an opening in the retaining device 86 to maintain the retaining device within the apertures 88, 88.

Figure 9A:
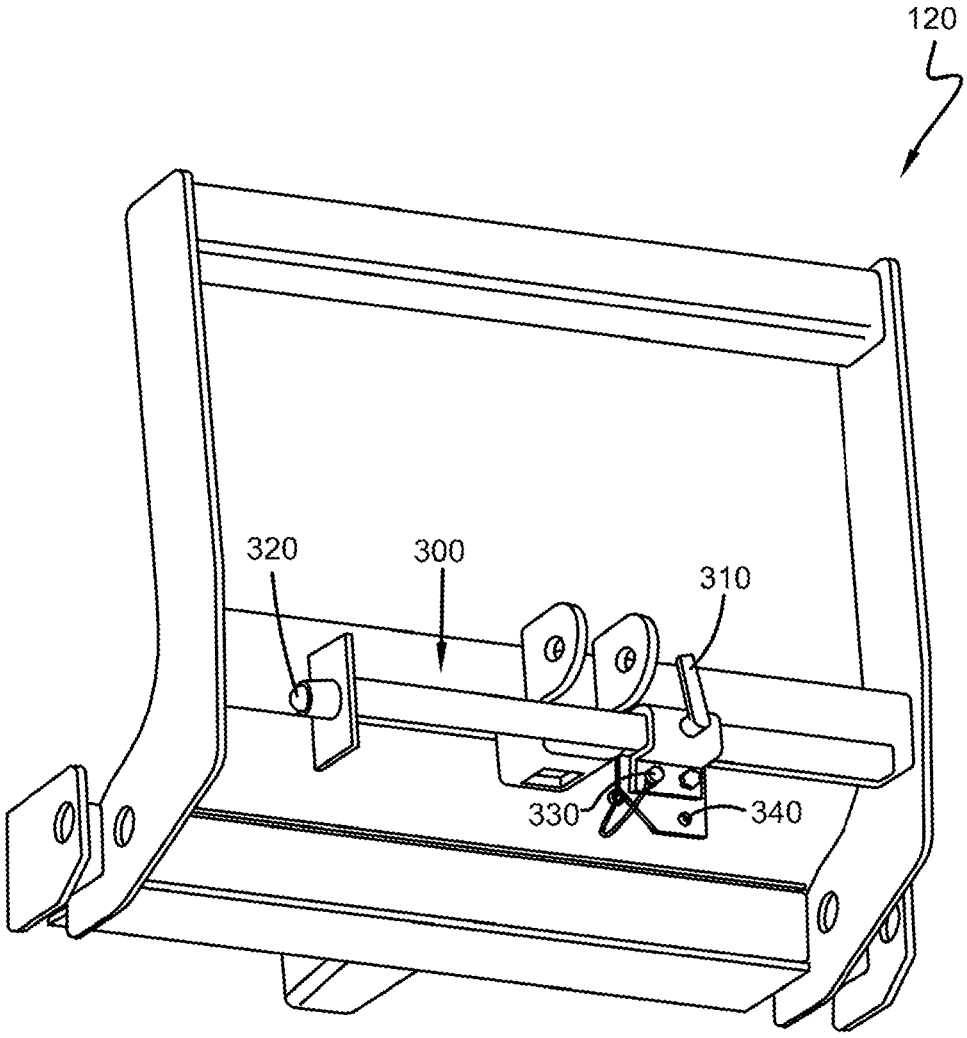
FIG. 9A is a perspective view of a jack stand shown in the storage position, according to one embodiment.
Figure 9B:
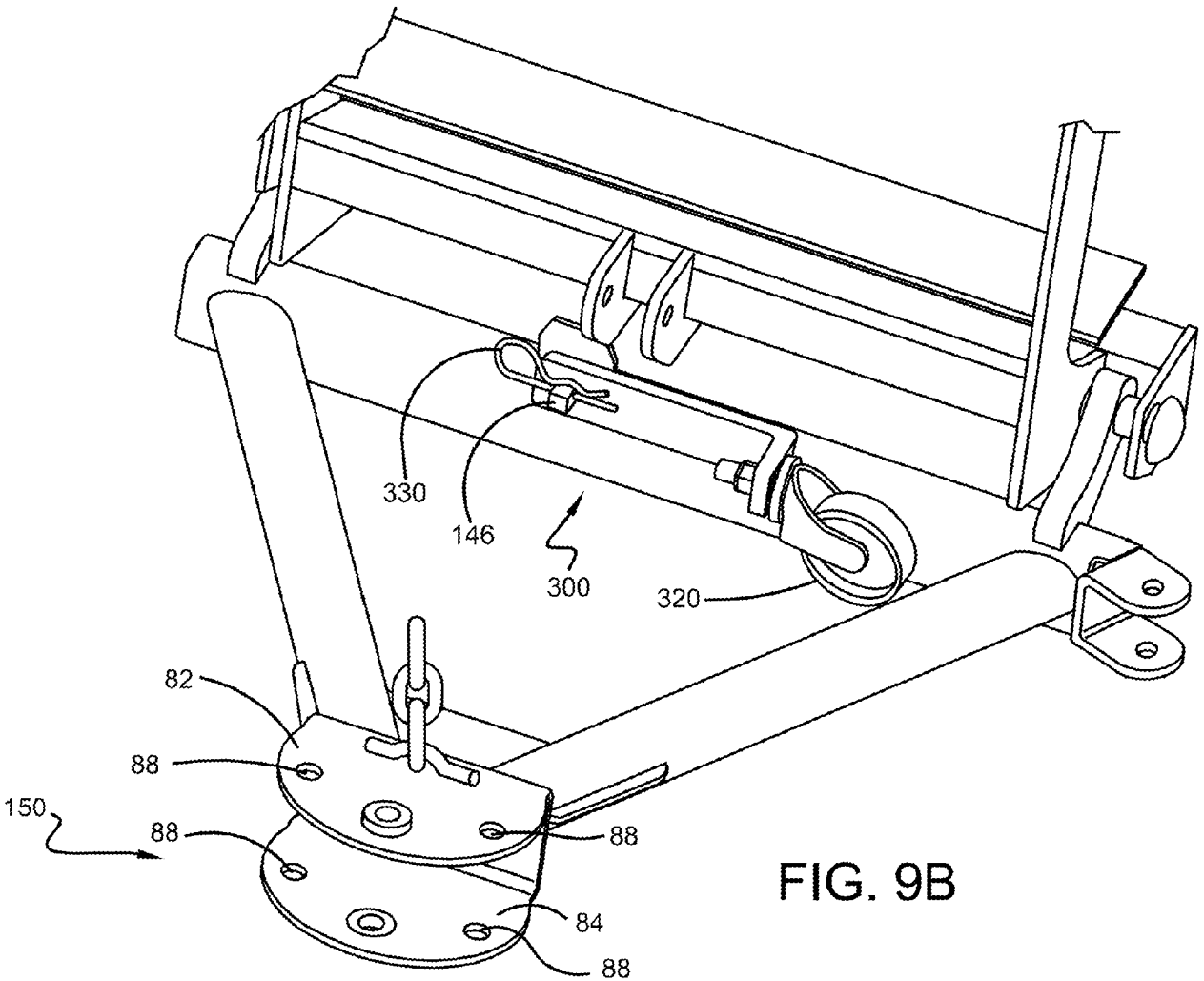
FIG. 9B is a perspective view of a jack stand shown in the storage position, according to one embodiment.
Figure 10A:
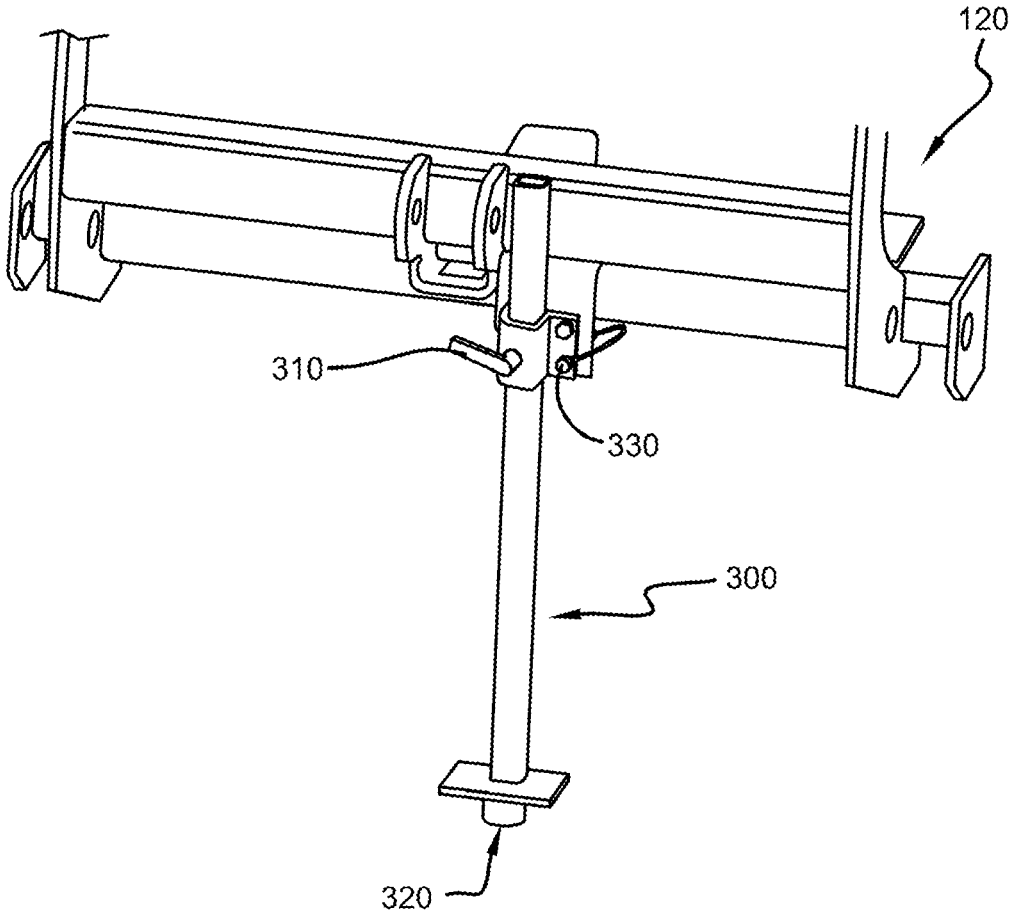
FIG. 10A is a perspective view of a jack stand shown in the use position, according to one embodiment.
Figure 10B:
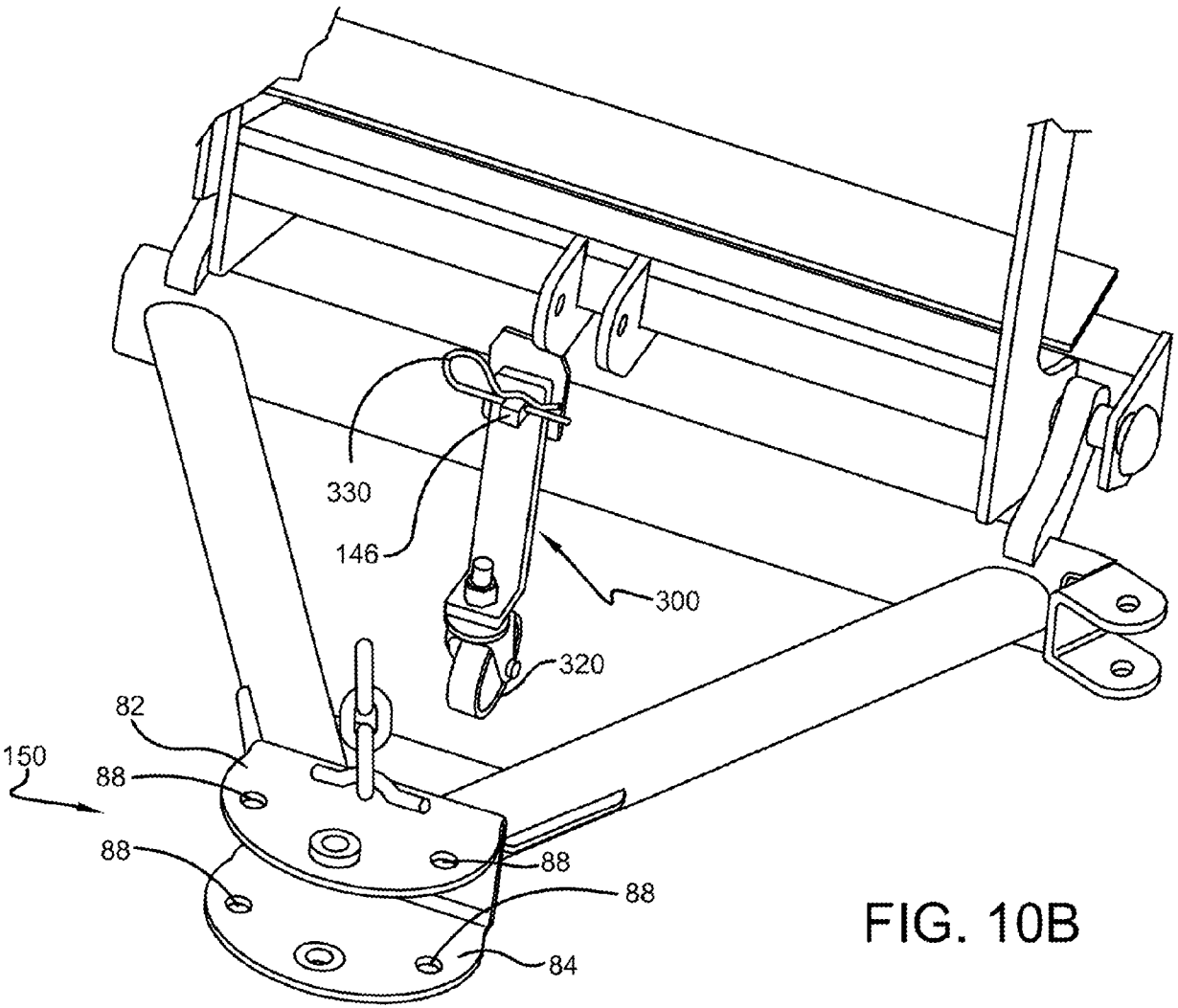
FIG. 10B is a perspective view of a jack stand shown in the use position, according to one embodiment.

With reference to FIGS. 9A, 9B, 10A, and 10B, the snowplow assembly 20 can include a jack stand 300 pivotally connected to the support assembly 120 or pivotally connected to the plow mount assembly 140 or A-frame. The jack stand 300 can support the snowplow assembly 20 when the snowplow assembly 20 is not attached to an associated vehicle. The jack stand 300 can pivot between a use position supporting the snowplow assembly, as shown in FIGS. 10A and 10B, and a storage position, as shown in FIGS. 9A and 9B. The jack stand 300 can include a height adjustment mechanism 310 to adjust the height of the jack stand 300. The height adjustment mechanism 310 can include an adjusting bolt to secure and release the jack stand 300. When the jack stand 300 is released, the height can be adjusted. The jack stand 300 can include a roller device 320 to contact a ground surface in the use position. The roller device 320 can be a roller ball, a ball bearing, a ball caster, a ball transfer or ball transfer unit, a caster, a wheel, or any other roller chosen with ordinary skill in the art. A retaining device or pin 330 can maintain the jack stand 300 in the use position or the storage position. The pin 330 can be inserted into an aperture in a plate 340 corresponding to the storage position, as shown in FIG. 9A, and the pin can be inserted into an aperture in the plate 340 corresponding to the use position, as shown in FIG. 10A. Alternatively, a retaining device or pin 330 can be inserted into an aperture 148 on a post 146 in the storage position, as shown in FIG. 9B, or in the use position, as shown in FIG. 10B. The post 146 can be positioned on the plow mount assembly 140 or A-frame. In some embodiments, the post 146 can be rectangular or square corresponding to a similarly shaped opening or aperture 302 in the jack stand 300. To move the jack stand 300 between the use and storage positions according to one embodiment, the retaining device 330 is removed from the post 146, the jack stand 300 is removed from the post 146, the jack stand 300 is turned to the appropriate position, the jack stand 300 is placed on the post 146, and the retaining device 330 is inserted into the aperture 148 on the post 146.

Figure 11B:
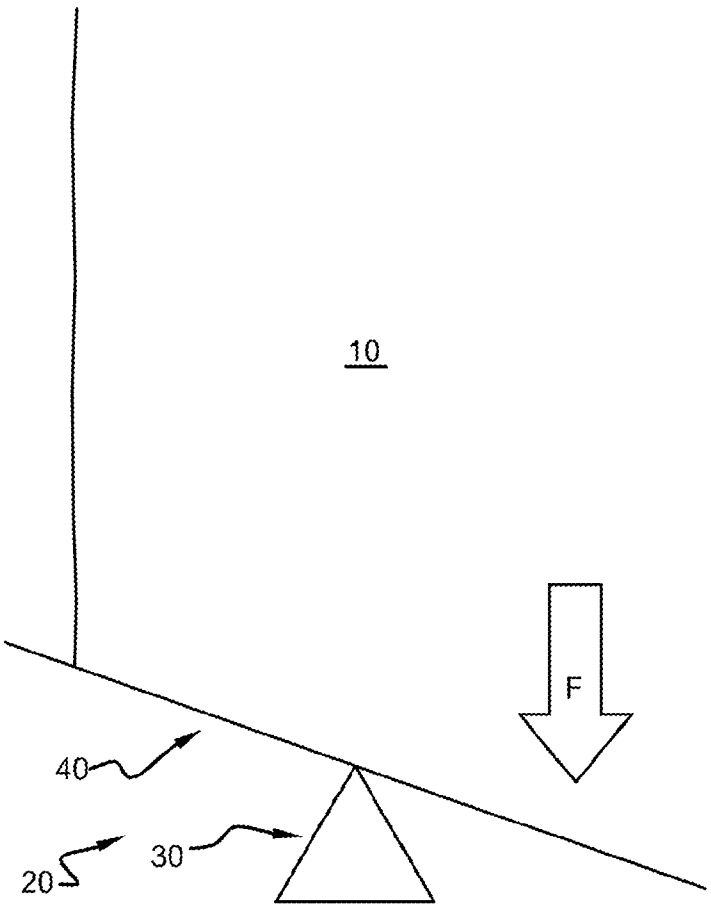
FIG. 11B is a schematic diagram illustrating the snowplow assembly in use with the snowplow in a second angled position, according to one embodiment.
Figure 11A:
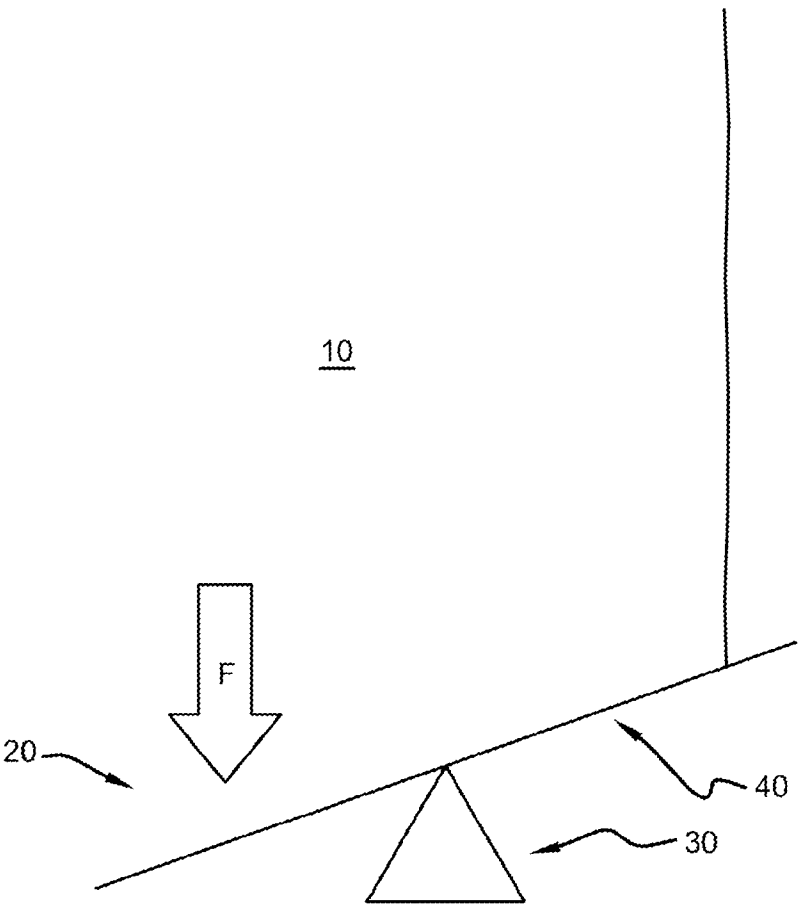
FIG. 11A is a schematic diagram illustrating the snowplow assembly in use with the snowplow in a first angled position, according to one embodiment.

With reference to all the FIGURES, the operation of the snowplow assembly 20 will be discussed, according to some embodiments. When the snowplow assembly 20 engages snow 10 in an offset condition, the force F of the snow 10 overcomes the force of the cylinder 200 and the plow blade assembly 40 pivots to the right or the left. According to the operation shown in FIG. 11A, the snowplow assembly 20 engages the snow 10 in an offset approach on the left side of the plow blade assembly 40. The force F of the snow 10 exerted on the plow blade 40 causes the plow blade assembly 40 to pivot to the left. When the snowplow assembly 20 disengages from the snow 10, the cylinder 200 returns the plow blade assembly 40 to a straight or neutral position. According to the operation shown in FIG. 11B, the snowplow assembly 20 engages the snow 10 in an offset approach on the right side of the plow blade assembly 40. The force F of the snow 10 exerted on the plow blade 40 causes the plow blade assembly 40 to pivot to the right. When the snowplow assembly 20 disengages from the snow 10, the cylinder 200 returns the plow blade assembly 40 to a straight or neutral position. While the operation of the snowplow assembly 20 shown in FIGS. 11A and 11B shows the plow blade pushing the snow 10, the snowplow assembly 20 can also be used to pull the snow 10.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A snowplow assembly comprising:

a mount assembly operatively connected to an associated vehicle;

a plow blade assembly including a plow blade with a snow engaging surface for plowing snow, wherein the plow blade assembly is pivotally connected to the mount assembly;

a cylinder including a cylinder housing, a piston, a piston rod, and first and second resilient members located substantially within the cylinder housing, wherein a first end of the cylinder is pivotally connected to the mount assembly and a second end of the cylinder is pivotally connected to the plow blade assembly;

wherein the first and second resilient members are in an equilibrium condition when the plow blade assembly is in a substantially straight position;

wherein the first resilient member compresses when the plow blade assembly is in a first angled position; and wherein the second resilient member compresses when the plow blade assembly is in a second angled position.

2. The snowplow assembly of claim 1 further comprising:

a second cylinder including a second cylinder housing, a second piston, a second piston rod, and third and fourth resilient members located substantially within the cylinder housing, wherein a first end of the second cylinder is pivotally connected to the mount assembly and a second end of the second cylinder is pivotally connected to the plow blade assembly;

wherein the third and fourth resilient members are in an equilibrium condition when the plow blade assembly is in a substantially straight position;

wherein the fourth resilient member compresses when the plow blade assembly is in a first angled position; and wherein the third resilient member compresses when the plow blade assembly is in a second angled position.

3. The snowplow assembly of claim 1 further comprising:

a locking device which can maintain the plow blade assembly in one of the first angled position or the second angled position.

4. The snowplow assembly of claim 1 further comprising:

a first stop device which limits the travel of the plow blade assembly in one of the first angled position or the second angled position.

5. The snowplow assembly of claim 4 further comprising:

a second stop device which limits the travel of the plow blade assembly in one of the first angled position or the second angled position.

6. The snowplow assembly of claim 1 further comprising:

first and second locking devices secured to the mount assembly;

first and second stop devices secured to the plow blade assembly;

wherein the first locking device can attach to the first stop device when the plow blade assembly is in the first angled position maintaining the plow blade assembly in the first angled position; and wherein the second locking device can attach to the second stop device when the plow blade assembly is in the second angled position maintaining the plow blade assembly in the second angled position.

7. The snowplow assembly of claim 1 further comprising:

a jack stand pivotally connected to the mount assembly, wherein the jack stand pivots between a use position supporting the snowplow assembly and a storage position.

8. The snowplow assembly of claim 7, wherein the jack stand further comprises:

a height adjustment mechanism to adjust the height of the jack stand; and a roller device positioned near one end of the jack stand to contact a ground surface in the use position.

9. A snowplow assembly comprising:

a mount assembly operatively connected to an associated vehicle;

a plow blade assembly including a plow blade with a snow engaging surface for plowing snow, wherein the plow blade assembly is pivotally connected to the mount assembly;

a cylinder including a cylinder housing, a piston, a piston rod, and first and second resilient members located substantially within the cylinder housing, wherein a first end of the cylinder is pivotally connected to the mount assembly and a second end of the cylinder is pivotally connected to the plow blade assembly;

wherein the first and second resilient members are in an equilibrium condition when the plow blade assembly is in a substantially straight position;

wherein the first resilient member extends when the plow blade assembly is in a first angled position; and wherein the second resilient member extends when the plow blade assembly is in a second angled position.

10. The snowplow assembly of claim 9 further comprising:

a second cylinder including a second cylinder housing, a second piston, a second piston rod, and third and fourth resilient members located substantially within the cylinder housing, wherein a first end of the second cylinder is pivotally connected to the mount assembly and a second end of the second cylinder is pivotally connected to the plow blade assembly;

wherein the third and fourth resilient members are in an equilibrium condition when the plow blade assembly is in a substantially straight position;

wherein the fourth resilient member extends when the plow blade assembly is in a first angled position; and wherein the third resilient member extends when the plow blade assembly is in a second angled position.

11. The snowplow assembly of claim 9, wherein the second resilient member compresses when the plow blade assembly is in a first angled position, and wherein the first resilient member compresses when the plow blade assembly is in a second angled position.

12. The snowplow assembly of claim 9 further comprising:

a locking device which can maintain the plow blade assembly in one of the first angled position or the second angled position.

13. The snowplow assembly of claim 9 further comprising:

a stop device which limits the travel of the plow blade assembly in one of the first angled position or the second angled position.

14. The snowplow assembly of claim 9 further comprising:

first and second locking devices secured to the mount assembly;

first and second stop devices secured to the plow blade assembly;

wherein the first locking device can attach to the first stop device when the plow blade assembly is in the first angled position maintaining the plow blade assembly in the first angled position; and wherein the second locking device can attach to the second stop device when the plow blade assembly is in the second angled position maintaining the plow blade assembly in the second angled position.

15. The snowplow assembly of claim 9 further comprising:

a jack stand pivotally connected to the mount assembly, wherein the jack stand pivots between a use position supporting the snowplow assembly and a storage position.

16. The snowplow assembly of claim 15, wherein the jack stand further comprises:

a height adjustment mechanism to adjust the height of the jack stand; and a roller device positioned near one end of the jack stand to contact a ground surface in the use position.

17. A snowplow assembly comprising:

a mount assembly operatively connected to an associated vehicle;

a plow blade assembly including a plow blade with a snow engaging surface for plowing snow, wherein the plow blade assembly is pivotally connected to the mount assembly;

a cylinder including a cylinder housing, a piston, a piston rod, and a resilient member located substantially within the cylinder housing, wherein a first end of the cylinder is pivotally connected to the mount assembly and a second end of the cylinder is pivotally connected to the plow blade assembly;

wherein the resilient member is in an equilibrium condition when the plow blade assembly is in a substantially straight position;

wherein the resilient member compresses when the plow blade assembly is in a first angled position; and wherein the resilient member extends when the plow blade assembly is in a second angled position.

18. The snowplow assembly of claim 17 further comprising:

a second cylinder including a second cylinder housing, a second piston, a second piston rod, and a second resilient member located substantially within the second cylinder housing, wherein a first end of the second cylinder is pivotally connected to the mount assembly and a second end of the cylinder is pivotally connected to the plow blade assembly;

wherein the second resilient member is in an equilibrium condition when the plow blade assembly is in a substantially straight position;

wherein the second resilient member extends when the plow blade assembly is in a first angled position; and wherein the second resilient member compresses when the plow blade assembly is in a second angled position.

19. The snowplow assembly of claim 17 further comprising:

first and second locking devices secured to the mount assembly;

first and second stop devices secured to the plow blade assembly;

wherein the first locking device can attach to the first stop device when the plow blade assembly is in the first angled position maintaining the plow blade assembly in the first angled position; and wherein the second locking device can attach to the second stop device when the plow blade assembly is in the second angled position maintaining the plow blade assembly in the second angled position.

20. The snowplow assembly of claim 17 further comprising:

a jack stand pivotally connected to the mount assembly, wherein the jack stand pivots between a use position supporting the snowplow assembly and a storage position.

* * * * *